US006450670B1

(12) United States Patent
Strauss et al.

(10) Patent No.: US 6,450,670 B1
(45) Date of Patent: Sep. 17, 2002

(54) LAMP ASSEMBLY WITH HEAT TRANSFER SYSTEM

(75) Inventors: Benjamin R. Strauss, Farmington Hills, MI (US); John D. Koehler, Flora, IL (US)

(73) Assignee: North American Lighting, Inc., Farmington Hills, MI (US)

( * ) Notice: Subject to any disclaimer, the term of this patent is extended or adjusted under 35 U.S.C. 154(b) by 0 days.

(21) Appl. No.: 09/396,587

(22) Filed: Sep. 15, 1999

(51) Int. Cl.[7] ..... F21V 29/00

(52) U.S. Cl. ..... 362/294; 362/264; 362/345; 362/353; 362/373; 362/547; 362/539

(58) Field of Search ..... 362/294, 345, 362/353, 539, 547, 373, 541, 218, 264

(56) References Cited

U.S. PATENT DOCUMENTS

| | | | | |
|---|---|---|---|---|
| 3,896,302 A | | 7/1975 | Whitney | 240/41 R |
| 4,029,985 A | | 6/1977 | Rachel | 313/115 |
| 4,628,415 A | | 12/1986 | Vescio et al. | 362/61 |
| 4,754,373 A | | 6/1988 | Otto et al. | 362/61 |
| 4,882,660 A | * | 11/1989 | Liverance et al. | 362/226 |
| 4,931,912 A | * | 6/1990 | Kawakami et al. | 362/547 |
| 5,010,452 A | * | 4/1991 | Krebser et al. | 362/19 |
| 5,510,968 A | | 4/1996 | Pokriefka et al. | 362/294 |
| 5,555,932 A | | 9/1996 | Dudley | 165/135 |
| 5,656,353 A | | 8/1997 | Butler | 428/133 |
| 5,846,634 A | | 12/1998 | Werth et al. | 428/128 |
| 865,531 A | * | 2/1999 | Frey et al. | 362/373 |

FOREIGN PATENT DOCUMENTS

| | | | |
|---|---|---|---|
| EP | 90330204 | 8/1989 | F21M/7/00 |

* cited by examiner

*Primary Examiner*—Stephen Husar
*Assistant Examiner*—Bertrand Zeade
(74) *Attorney, Agent, or Firm*—McDonnell Boehnen Hulbert & Berghoff

(57) ABSTRACT

A lamp assembly having a lamp housing defining an internal cavity with at least one side. The at least one side has an opening. The lamp assembly further includes a heat transfer plate attached to the at least one side, positioned outside of the internal cavity, and at least partially aligned with the opening to transfer heat away from the lamp housing. The lamp assembly may also have a sealing gasket positioned between the heat transfer plate and the at least one side of the lamp housing. In addition, the lamp assembly may further include a bulb shield with an arm connected to the heat transfer plate, and a shell connected to the arm opposite the heat transfer plate. The shell may be adapted to at least partially cover a bulb of the lamp assembly.

20 Claims, 4 Drawing Sheets

LAMP ASSEMBLY WITH HEAT TRANSFER SYSTEM

FIELD OF INVENTION

The present invention relates to a heat transfer system for a lamp assembly, such as an automotive headlamp, fog lamp, signal light, or taillight. More specifically, it relates to a lamp assembly having an external heat transfer plate, with or without a bulb shield, for transferring heat out of away from the lamp assembly to the ambient environment.

BACKGROUND OF THE INVENTION

During use, the bulb of a typical lamp reaches relatively high temperatures and generates excess heat. Such excess heat from the bulb can melt, deform, or otherwise cause damage to the lamp housing surrounding the bulb, especially when the lamp housing is made from an inexpensive plastic material. While any side of the lamp housing may have one or more areas susceptible to heat damage, the top side of the lamp housing above the bulb generally suffers the greatest damage due to the excess heat rising from the bulb.

One way to prevent heat damage to the lamp housing is to increase the distance from the bulb to the sides of the lamp housing. Similarly, another way is to increase the overall volume of the cavity defined by the lamp housing for the bulb. Alternatively, the power output (i.e., wattage) of the bulb may be reduced, or the lamp housing may be made of a more expensive material with a relatively high resistance to heat. The problem with each of these known solutions is that they require either an increase in size, a reduction in power output, and/or an increase in the cost of manufacturing the lamp. Since the size and power output of most lamps is restricted and dictated by manufacturing and regulatory specifications, along with the low cost objectives for manufacturing, these known solutions are undesirable for substantially reducing or preventing heat damage to lamp housings from their bulbs.

An alternative solution to the problem of heat damage to lamp housings caused by bulbs involves the use of heat shields or bulb shields. An example of a heat shield for an automotive back light assembly is disclosed in U.S. Pat. No. 5,510,968 to Pokriefka et al., and an example of an automotive bulb shield is disclosed in U.S. Pat. No. 3,896,302 to Whitney. The problem with the heat shields and bulb shields known in the prior art, however, is that they are positioned internally within the lamp housing. Accordingly, while the heat shields and bulb shields of the prior art absorb some of the excess heat generated by the bulb, they do not remove or dissipate the absorbed heat outside and away from the lamp housing. As a result, the heat released internally by these heat shields and bulb shields of the prior art may still cause damage to the lamp housing.

Accordingly, it would be desirable to have a heat transfer system for a lamp assembly that overcomes the problems associated with the prior art by having an externally mounted heat transfer plate for transferring and dissipating heat outside of and away from the lamp assembly to the ambient environment. Such a heat transfer system would substantially reduce or prevent heat damage to the lamp housing from the bulb, without requiring an increase in the size of the lamp housing, a decrease in the power output, or an increase in the manufacturing cost of the lamp assembly.

SUMMARY OF THE INVENTION

The present invention provides a lamp assembly comprising a lamp housing defining and internal cavity and having at least one side with an opening. The lamp assembly also comprises a heat transfer plate attached to the at least one side, positioned outside of the internal cavity, and at least partially aligned with the opening to transfer heat away from the lamp housing. In addition, the lamp assembly may also comprise a bulb shield having an arm connected to the heat transfer plate, and a shell connected to the arm opposite the heat transfer plate, with the shell being adapted to at least partially cover a bulb.

The present invention further provides a lamp assembly comprising a bulb having a filament portion and a socket opposite the filament portion, and a lamp housing having a top side with an exterior surface and an opening aligned with the filament portion of the bulb. The lamp assembly also comprises a heat transfer plate mounted over the opening on the exterior surface of the top side to transfer heat away from the lamp housing. The lamp assembly further comprises a sealing gasket positioned between the heat transfer plate and the top side of the lamp housing.

DETAILED DESCRIPTION OF PREFERRED EMBODIMENTS

Figure 1:
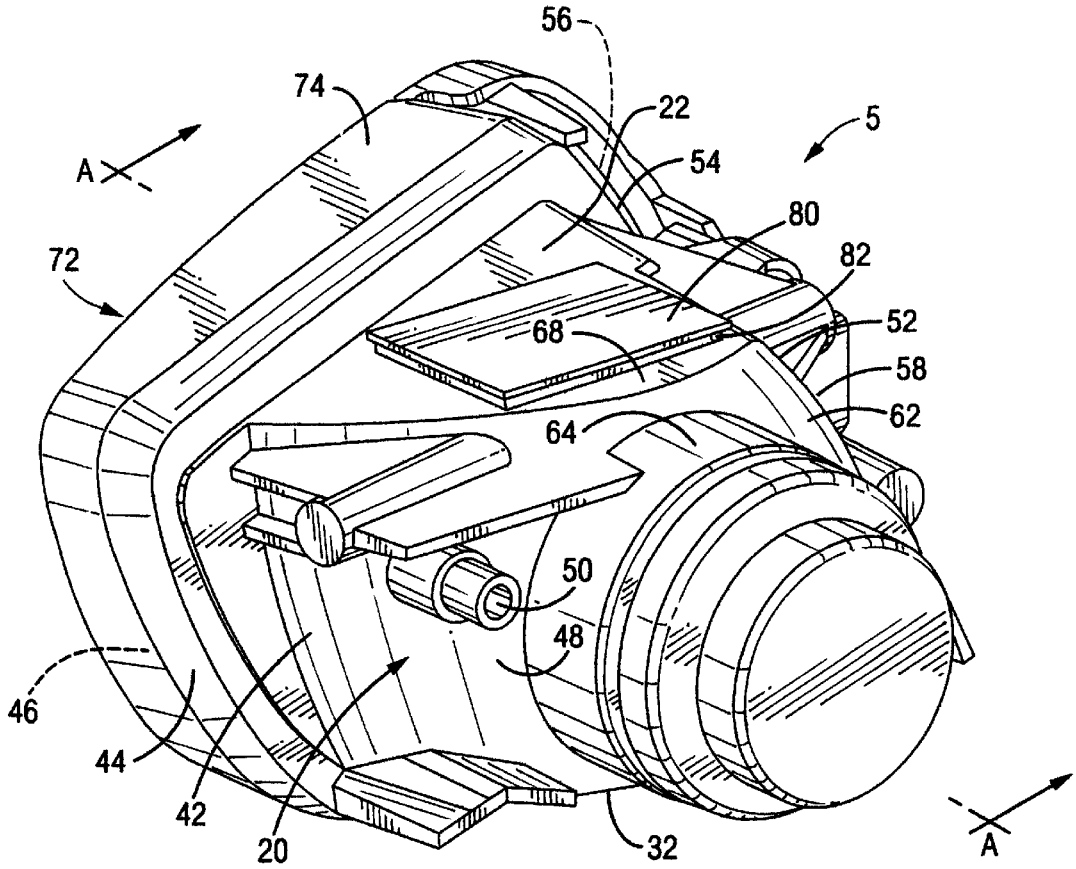
FIG. 1 is a back perspective view of a preferred embodiment of a lamp assembly of the present invention.
Figure 2:
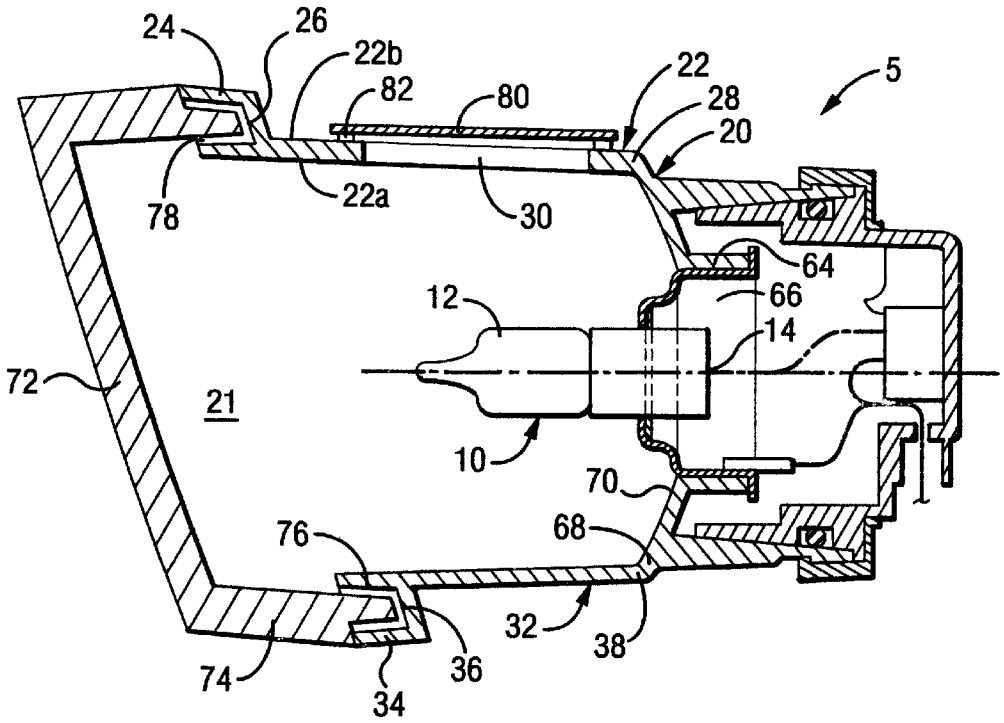
FIG. 2 is a cross-sectional view of the lamp assembly of FIG. 1 taken along line A—A, without a bulb shield of the present invention.

Turning now to the drawings, FIGS. 1–2 show a preferred embodiment of a lamp assembly 5 of the present invention. The lamp assembly 5 comprises a lamp bulb 10, a lamp housing 20, a lens 72, and a heat transfer plate 80. The lamp bulb 10 has a light and heat generating filament portion 12, and a socket 14 opposite the filament portion. It should be understood, however, that the socket 14 may be an integral component of the lamp bulb 10, or alternatively, may be a separate component connected to the lamb bulb 10. Although an incandescent bulb is shown in FIG. 1, it should also be understood that any desirable type of lamp bulb may be used with the lamp assembly of the present invention, depending upon regulatory, manufacturing, and/or consumer preferences.

As shown in FIG. 2, the lamp housing 20 defines an internal cavity 21. Preferably, but not necessarily, the lamp housing 20 is made from a plastic, such as polycarbonate or ABS. The lamp housing 20 also has a top side 22 with an interior surface 22*a* facing the internal cavity 21, and an exterior surface 22*b* opposite the interior surface 22*a*. The top side 22 also has a front end 24 with a lens slot 26, and a second end 28. In addition, the top side 22 has an opening 30 positioned above and at least partially aligned with the filament portion 12 of the lamp bulb 10.

The opening 30 is preferably positioned within the top side 22 and above the filament portion 12 of the lamp bulb 10, because this area is usually exposed to the greatest risk of damage from excessive heat generated by the lamp bulb 10. It should be understood, however, that the opening 30 may be positioned elsewhere within the lamp housing (i.e., another side), depending on the configuration of the lamp assembly and the location of the area with the greatest risk of damage from excessive heat generated by the lamp bulb. In other words, the opening 30 is preferably positioned in the area of the lamp housing with the greatest risk of heat damage, which may be a portion of the top side or some other side.

The lamp housing 20 also has a bottom side 32 spaced from and opposite the top side 22. The bottom side 32 has a first end 34 with a lens slot 36, and a second end 38. The lamp housing 20 also has a first side 42 and a second side 52 spaced from the first side. The first and second sides 42, 52 connect the top side 22 to the bottom side 32, and may be curved, as shown in FIG. 1. Like the top side 22 and the bottom side 32, the first side 42 and the second side 52 each have a first end 44, 54 with a lens slot 46, 56, and a second end 48, 58, respectively. As known in the art, either the first side 42 of the second side 52, or both, may have one or more vent holes 50 to provide an outlet for releasing excess fluids, heat, and/or pressure within the lamp housing 20.

As shown in FIGS. 1–2, the lamp housing 20 further includes a back side 62. The back side 62 has a first end 64 with an aperture 66, and a second end 68 connected to the second ends 28, 38, 48, 58 of the top, bottom, first, and second sides 22, 32, 42, 52. The aperture 66 is adapted to receive and hold the socket 14 of the lamp bulb 10. Preferably, the back side 62 is at least partially curved and has a reflective inner surface 70 for reflecting and imaging emitted light from the lamp bulb 10 forward away from the back side 62. In addition, the top, bottom, first, second, and back sides 22, 32, 42, 52, 62 are preferably formed integral with one another. For instance, injection molding may be used to form the top, bottom, first, second, and back sides 22, 32, 42, 52, 62 into a unitary and integral lamp housing 20, as shown in FIG. 1.

The lens 72 of the lamp assembly 5 of the present invention preferably has an outwardly extending flange 74. The flange 74 is adapted to be positioned within a lens groove 76 that is formed and defined by the lens slots 26, 36, 46, 56 of the top, bottom, first, and second sides 22, 32, 42, 52. In order to form a seal between the lens 72 and the lamp housing 20, an adhesive 78, such as silicone, may be inserted between the flange 74 of the lens 72 and the lens groove 76. As an alternative to an adhesive, vibration welding or another well-known attachment method may be used to seal the lens 72 to the lamp housing 20. Although a polycarbonate lens is shown in FIG. 2, it should be understood that any desirable type of lens may be used with the lamp assembly of the present invention, depending on regulatory, manufacturing, and/or consumer preferences. Preferably, however, the lens 72 is made from a transparent or translucent glass or plastic.

As shown in FIGS. 1–2, the heat transfer plate 80 is preferably attached to and mounted on the exterior surface 22*b* of the top side 22, at least partially aligned with and over the opening 30. A sealing gasket 82 is also preferably positioned between the heat transfer plate 80 and the top side 22 to form a seal between the heat transfer plate 80 and the lamp housing 20. The sealing gasket 82 may be attached to the top side 22 (e.g., the exterior surface 22*b*) of the lamp housing 20 and/or to the heat transfer plate 80 with an adhesive or fastener (not shown), such as a screw, snap, or clip.

Preferably, the shape and size of the heat transfer plate 80 corresponds and matches the shape and size of the opening 30, with the heat transfer plate slightly overlapping the opening for ease of attaching or mounting. The heat transfer plate 80 is preferably made from steel, but may alternatively be made from another material, such as aluminum or copper, that can withstand relatively high temperatures. Since the opening 30 may be located within one of the other sides (i.e., bottom side 32, first side 42, or second side 52), and the heat transfer plate is mounted over the opening 30, it should be understood that heat transfer plate 80 may also be mounted on one of the other sides. In addition, it should be further understood that with the lens 72 and the heat transfer plate 80 being connected and mounted to the lamp housing 20 with sealing gaskets 78, 82, and without any vent holes, the lens 72, the heat transfer plate 80, and the lamp housing 20 together form a sealed lamp assembly 5. Moreover, the sealing gaskets are preferably made from a thermally non-conductive material, such as nylon. As a result, the temperature and amount of heat conducted and received by the heat transfer plate may exceed the temperature and amount of heat received and conducted by the lamp housing.

The lamp assembly 5 of the present invention operates in the following manner. During its use, the filament portion of the lamp bulb generates excess heat within the internal cavity of the lamp housing. The convective portion of the generated heat travels upward from the filament portion of the lamp bulb toward the top side of the lamp housing. The excess heat from the lamp bulb then continues to travel upward through the opening (which is preferably located directly over and above the filament portion of the lamp bulb) of the top side of the housing. Next, the excess heat passing through the opening of the top side of the lamp housing is conducted and absorbed by the heat transfer plate mounted on the top side, outside the internal cavity, and over the opening within the top side of the lamp housing. After conducting this excess heat from the lamp bulb, the heat transfer plate transfers the heat outside of the internal cavity and away from the lamp housing, with the heat dissipating into the surrounding ambient environment (i.e., atmosphere). As a result of this arrangement, the excess heat generated by the lamp bulb within the internal cavity that travels upwards toward the top side of the lamp housing is passed through the opening and transferred out of and away from the lamp housing via the heat transfer plate. Thus, the top side, which is preferably made of a plastic material, is not excessively melted, deformed, or damaged by the excess heat generated from the lamp bulb.

Figure 3:
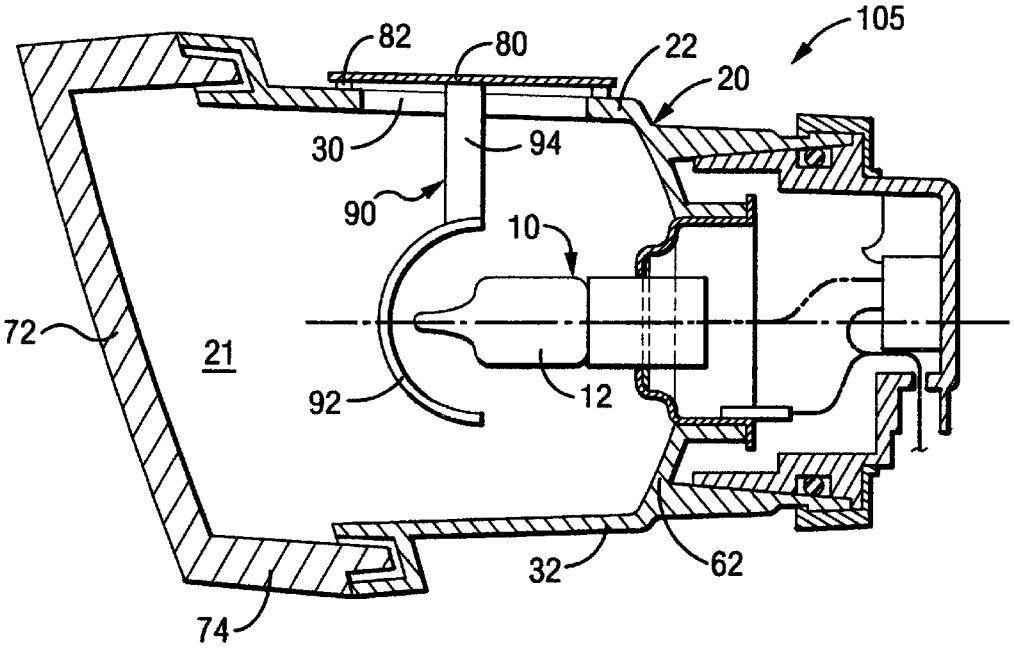
FIG. 3 is a cross-sectional view of the lamp assembly of FIG. 1 taken along line A—A, with a bulb shield of the present invention.

FIG. 3 shows an alternative embodiment of a lamp assembly 105 of the present invention. The lamp assembly 105 is identical to, and operates in the same manner as, the lamp assembly 5 shown in FIGS. 1–2, with only a few exceptions. To avoid redundancy and unnecessary repetition, only the differences between the lamp assembly 105 and the lamp assembly 5 will be discussed in detail below. Similarly, for ease of illustration, only some of the components of the lamp assembly 105 are identified by reference numerals in FIG. 3. Preferably, the non-identified components of the lamp assembly 105 are identical to the corresponding components of the lamp assembly 5.

The primary difference between the lamp assembly 105 and the lamp assembly 5 is that the lamp assembly 105 further comprises a bulb shield 90 with a shell 92 and an arm 94. The shell 92 is adapted and designed to at least partially cover the filament portion 12 of the lamp bulb 10, and to conduct and absorb the excess heat generated by the filament portion 12 of the lamp bulb 10. The arm 94 is connected to both the shell 92 and the heat transfer plate 80, thereby providing a conduit for heat to be transferred from the bulb shield 90 to the heat transfer plate 80. Preferably, but not necessarily, both the shell 92 and the arm 94 of the bulb shield 90 are made from steel. Alternatively, the shell 92 and/or the arm 94 of the bulb shield 90 may be made from another material, such as aluminum or cooper, that can withstand relatively high temperatures.

The lamp assembly 105 operates in the following manner. Excess heat generated from the lamp bulb is captured and conducted by the shell of the bulb shield. The excess heat captured and conducted by the shell is then transferred along the arm of the bulb shield to the heat transfer plate. As with lamp assembly 5, the heat transfer plate of the lamp assembly 105 then transfers and dissipates the excess heat away from the lamp housing to the surrounding ambient environment (i.e., atmosphere). As a result, excess heat from the lamp bulb is conducted by the shell, transferred along the arm to the heat transfer plate, and dissipated outside the lamp housing to the ambient environment, thereby substantially reducing or preventing heat damage to the lamp housing.

Figure 4:
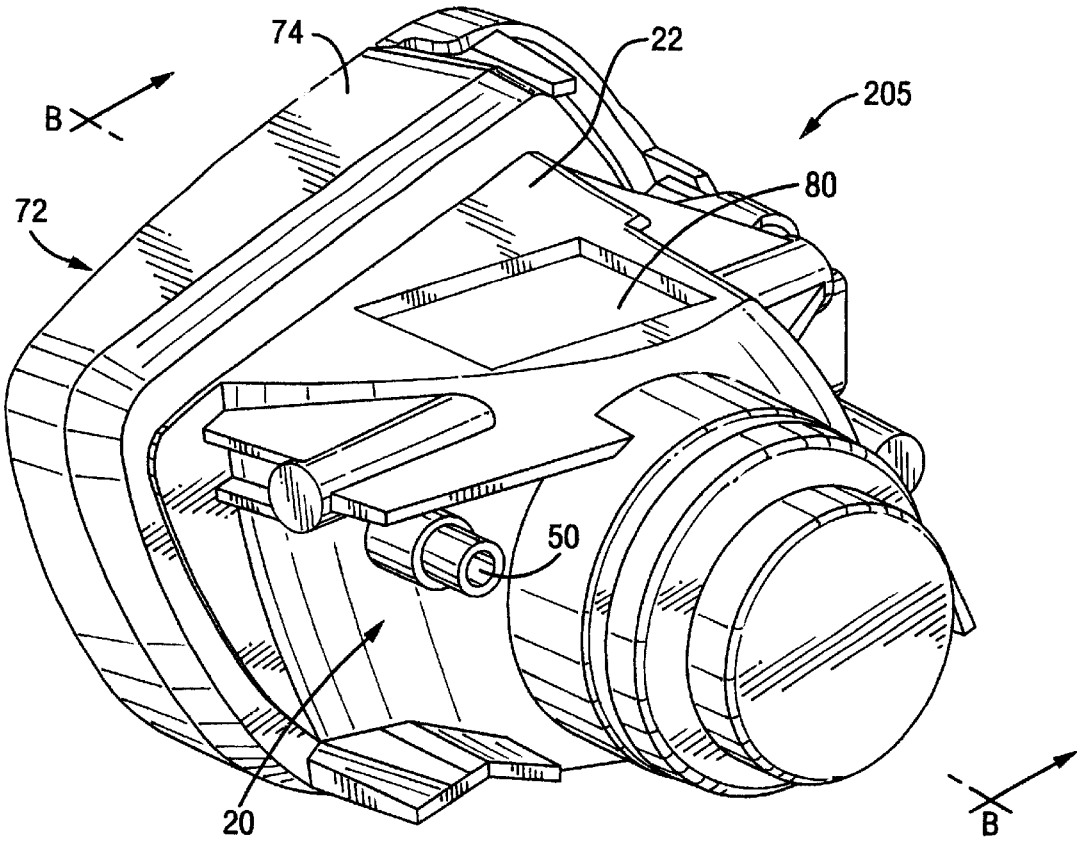
FIG. 4 is a back perspective view of an alternative embodiment of a lamp assembly of the present invention.
Figure 5:
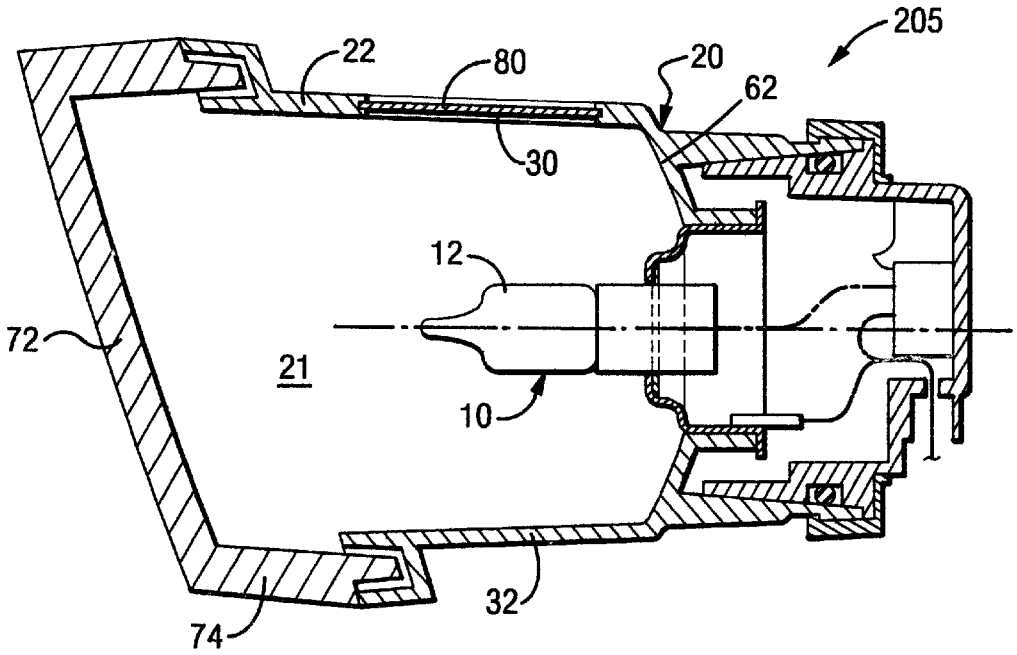
FIG. 5 is a cross-sectional view of the lamp assembly of FIG. 4 taken along line B—B, without a bulb shield of the present invention.

FIGS. 4–5 show another alternative embodiment of lamp assembly 205 of the present invention. The lamp assembly 205 is identical to, and operates in the same manner as, the lamp assembly 5 shown in FIGS. 1–2, with only a few exceptions. To avoid redundancy and unnecessary repetition, only the differences between the lamp assembly 205 and the lamp assembly 5 will be discussed in detail below. Similarly, for ease of illustration, only some of the components of the lamp assembly 205 are identified by reference numerals in FIGS. 4–5. Preferably, the non-identified components of the lamp assembly 205 are identical to the corresponding components of the lamp assembly 5.

The primary difference between the lamp assembly 205 and the lamp assembly 5 is that the heat transfer plate 80 of the lamp assembly 205 is attached to and mounted within the top side 22, rather than mounted on the top side 22. Insert molding may be used to position the heat transfer plate 80 within the opening 30 of the top side 22, as shown in FIG. 5. As a result of this arrangement, the sealing gasket 82 is preferably not utilized with the lamp assembly 205.

Figure 6:
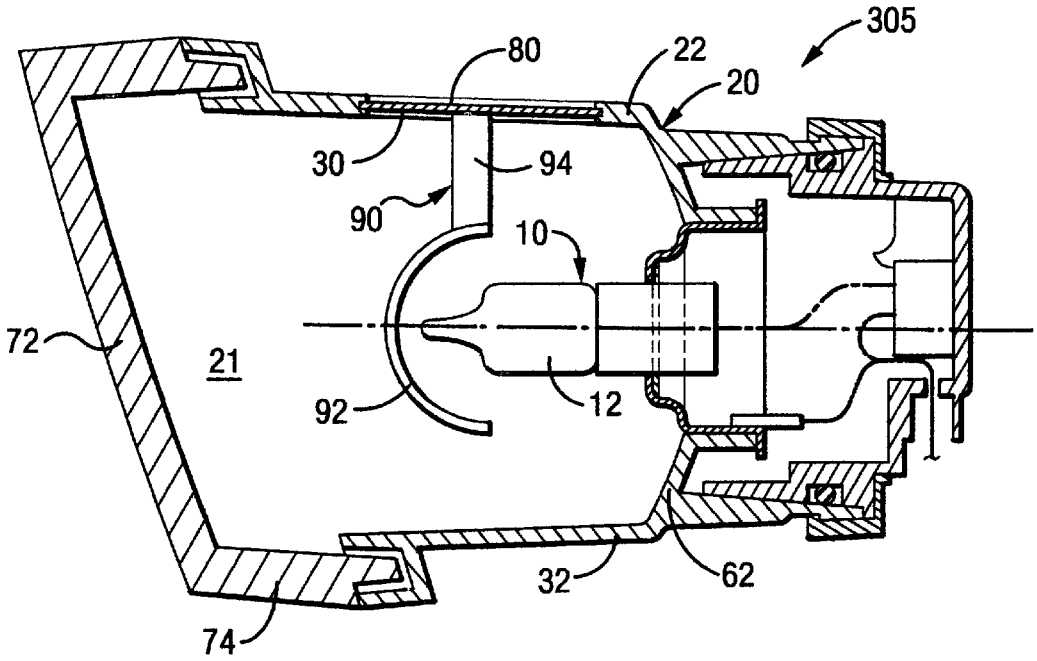
FIG. 6 is a cross-sectional view of the lamp assembly of FIG. 4 taken along line B—B, with a bulb shield of the present invention.

FIG. 6 shows yet another alternative embodiment of a lamp assembly 305 of the present invention. The lamp assembly 305 is identical to, and operates in the same manner as, the lamp assembly 105 shown in FIG. 3, with only a few exceptions. To avoid redundancy and unnecessary repetition, only the differences between the lamp assembly 305 and the lamp assembly 105 will be discussed in detail below. Similarly, for ease of illustration, only some of the components of the lamp assembly 305 are identified by reference numerals in FIG. 6. Preferably, the non-identified components of the lamp assembly 305 are identical to the corresponding components of the lamp assembly 105.

The primary difference between the lamp assembly 305 and the lamp assembly 105 is that the heat transfer plate 80 of the lamp assembly 305 is attached to and mounted within the top side 22, rather than mounted on the top side 22. Insert molding may be used to position the heat transfer plate 80 within the opening 30 of the top side 22, as shown in FIG. 6. As a result of this arrangement, the sealing gasket 82 is preferably not utilized with the lamp assembly 305.

While the lamp assemblies of the present invention may be applied with particular advantage to head lamps, fog lamps, signal lights, and/or taillights of automotive vehicles, the lamp assemblies of the present invention may also be used with other lamps and lights for automotive vehicles, or with lamps and lights unrelated to automotive vehicles. It should also be readily apparent from the foregoing description and accompanying drawings that the lamp assemblies of the present invention are improvements over the prior art. In particular, the lamp assemblies of the present invention allow the lamp housing to be made of a relatively inexpensive material, such as plastic, while providing an external heat transfer plate (with or without a bulb shield) to remove excess heat from the internal cavity of the lamp housing and to substantially reduce or prevent heat damage to the lamp housing.

Those skilled in the art to which the invention pertains may make modifications and other embodiments employing the principles of this invention without departing from its spirit or essential characteristics, particularly considering the foregoing teachings. Accordingly, the described embodiments are to be considered in all respects only as illustrative and not restrictive, and the scope of the invention is, therefore, indicated by the appended claims rather than by the foregoing description. Consequently, while the invention has been described with reference to particular embodiments, modifications of structure, sequence, materials, and the like would be apparent to those skilled in the art, yet would still fall within the scope of the invention.

What is claimed is:

1. A lamp assembly comprising:

a vehicle lamp housing defining an internal cavity, the vehicle lamp housing having an aperture for accepting a socket of a light bulb and at least one side with an opening; and a heat transfer plate attached to the at least one side, the heat transfer plate being positioned outside of the internal cavity and at least partially aligned with the opening to transfer heat away from the vehicle lamp housing.

2. The lamp assembly of claim 1 wherein the at least one side of the vehicle lamp housing is a top side.

3. The lamp assembly of claim 2 wherein the vehicle lamp housing further includes a bottom side opposite the top side, and opposing first and second sides connecting the top side to the bottom side, the top, bottom, first, and second sides each having a first end connected to a lens, and a second end connected to a back side.

4. The lamp assembly of claim 3 wherein at least a portion of the back side has a reflective inner surface.

5. The lamp assembly of claim 3 wherein the top, bottom, first, second, and back sides are formed integral with one another.

6. The lamp assembly of claim 3 wherein each first end of the top, bottom, first, and second sides has a slot for receiving the lens.

7. The lamp assembly of claim 1 wherein a sealing gasket is positioned between the heat transfer plate and the at least one side of the vehicle lamp housing.

8. The lamp assembly of claim 1 wherein the heat transfer plate is made from one of steel, aluminum, and copper.

9. The lamp assembly of claim 1 wherein the vehicle lamp housing and the heat transfer plate together form a sealed lamp assembly.

10. The lamp assembly of claim 1 wherein the heat transfer plate is mounted on the at least one side of the vehicle lamp housing.

11. The lamp assembly of claim 1 wherein the heat transfer plate is mounted within the at least one side of the vehicle lamp housing.

12. A lamp assembly comprising:

a vehicle lamp housing defining an internal cavity, the vehicle lamp housing having an aperture for accepting a socket of a light bulb and at least one side with an opening;

a heat transfer plate attached to the at least one side, the heat transfer plate being positioned outside of the internal cavity and at least partially aligned with the opening to transfer heat away from the vehicle lamp housing; and a bulb shield having an arm connected to the heat transfer plate, and a shell connected to the arm opposite the heat transfer plate, the shell being adapted to at least partially cover a bulb.

13. The lamp assembly of claim 12 wherein the at least one side of the vehicle lamp housing is a top side.

14. The lamp assembly of claim 13 wherein the vehicle lamp housing further includes a bottom side opposite the top side, and opposing first and second sides connecting the top side to the bottom side, the top, bottom, first, and second sides each having a first end connected to a lens, and a second end connected to a back side.

15. The lamp assembly of claim 14 wherein the back side is adapted to receive a bulb and at least a portion of the back side has a reflective inner surface.

16. The lamp assembly of claim 12 wherein the heat transfer plate, the arm, and the shell are formed integral with one another.

17. The lamp assembly of claim 14 wherein each first end of the top, bottom, first, and second sides has a slot for receiving the lens.

18. The lamp assembly of claim 12 wherein a sealing gasket is positioned between the heat transfer plate and the at least one side of the lamp housing.

19. The lamp assembly of claim 12 wherein the bulb shield and the heat transfer plate are made from steel.

20. A lamp assembly comprising:

a bulb having a filament portion and a socket opposite the filament portion;

an automotive lamp housing having an aperture for accepting a socket of a light bulb and a top side with an exterior surface and an opening, the opening being aligned with the filament portion of the bulb;

a heat transfer plate mounted over the opening on the exterior surface of the top side to transfer heat away from the lamp housing; and a sealing gasket positioned between the heat transfer plate and the top side of the automobile lamp housing.

* * * * *